US012605029B1

(12) United States Patent
Guo

(10) Patent No.: US 12,605,029 B1
(45) Date of Patent: Apr. 21, 2026

(54) STEAM CLEANER

(71) Applicant: Hongpeng Guo, Guangdong (CN)

(72) Inventor: Hongpeng Guo, Guangdong (CN)

( * ) Notice: Subject to any disclaimer, the term of this patent is extended or adjusted under 35 U.S.C. 154(b) by 0 days.

(21) Appl. No.: 19/402,954

(22) Filed: Nov. 26, 2025

(51) Int. Cl.
*A47L 11/40* (2006.01)
*A47L 11/34* (2006.01)
*F04B 9/14* (2006.01)

(52) U.S. Cl.
CPC ..... *A47L 11/4086* (2013.01); *A47L 11/34* (2013.01); *A47L 11/4005* (2013.01); *A47L 11/4008* (2013.01); *A47L 11/4011* (2013.01); *A47L 11/4075* (2013.01); *A47L 11/4083* (2013.01); *A47L 11/4088* (2013.01); *F04B 9/14* (2013.01)

(58) Field of Classification Search
CPC .. A47L 11/4086; A47L 11/34; A47L 11/4005; A47L 11/4008; A47L 11/4011; A47L 11/4075; A47L 11/4083; A47L 11/4088; F04B 9/14
See application file for complete search history.

(56) References Cited

U.S. PATENT DOCUMENTS

2021/0169294 A1* 6/2021 Pruiett ..... A47L 11/4016

* cited by examiner

*Primary Examiner* — Andrew A Horton
(74) *Attorney, Agent, or Firm* — Hawaii Patent Services; Nathaniel K. Fedde; Kenton N. Fedde

(57) ABSTRACT

The present disclosure relates to a steam cleaner, comprising a housing, a liquid storage assembly, a liquid pumping assembly, an execution unit and a control assembly. The liquid storage assembly includes a water storage part and a liquid storage part. The first pump assembly of the liquid pumping assembly draws clean water to generate steam through the heating assembly, and the second pump assembly quantitatively draws cleaning liquid through the pressing handle and piston pump. The two are mixed and sprayed out the nozzle channel, achieving synergistic cleaning with steam and cleaning liquid, improving cleaning efficiency, and offering convenient and safe operation.

20 Claims, 9 Drawing Sheets

STEAM CLEANER

TECHNICAL FIELD

The present disclosure relates to the technical field of cleaning equipment, and particularly to a steam cleaner.

BACKGROUND

In the field of cleaning, existing cleaning liquid products are typically applied directly to the surface to be cleaned during use. Their cleaning effect relies on the chemical action of the cleaning liquid itself and fails to combine with the physical cleaning efficacy of high-temperature steam. Research and experiments have shown that high-temperature steam (approximately 100° C.) can significantly activate the active ingredients of the cleaning liquid, greatly improving its stain removal efficiency and cleaning effect. However, existing technology lacks a cleaning liquid storage and delivery structure capable of adapting to the synergistic effect of cleaning liquid and high-temperature steam. That is, existing cleaning liquid tanks cannot meet the usage requirement of simultaneous spraying and mixing of cleaning liquid and steam, resulting in the cleaning potential of the cleaning liquid not being fully utilized. There is an urgent need to design a cleaning liquid storage and delivery equipment that enables the synergistic jetting of cleaning liquid and steam, to integrate the dual cleaning advantages of high-temperature steam and cleaning liquid, thereby improving cleaning efficiency and effectiveness.

SUMMARY

The present disclosure provides a steam cleaner to solve the problems raised in the above background art.

To achieve the above object, the present disclosure adopts the following technical solutions:

A steam cleaner includes a housing; a liquid storage assembly, comprising a water storage part and a liquid storage part, wherein the water storage part is configured to contain clean water, and the liquid storage part is configured to contain a cleaning liquid; a liquid pumping assembly, comprising a first pump assembly and a second pump assembly, wherein the first pump assembly is fluidly connected to the water storage part for drawing the clean water, and the second pump assembly is fluidly connected to the liquid storage part for drawing the cleaning liquid; an execution unit, comprising a heating assembly and a nozzle, wherein the heating assembly is fluidly connected to the first pump assembly for heating the clean water received from the first pump assembly to generate steam, the nozzle is installed on the housing, and the nozzle is configured to be internally hollow to form a channel; and a control assembly configured to be electrically connected to the first pump assembly and the heating assembly to control on/off of the two.

The nozzle is fluidly connected to the heating assembly and the second pump assembly respectively, the channel is configured to allow steam generated by the heating assembly to enter the channel to be sprayed out from a spray orifice, or to allow the steam generated through the heating assembly and the cleaning liquid drawn through the second pump assembly to mix within the channel, forming a mixed fluid to be sprayed out from the spray orifice.

A steam cleaner includes a housing; a liquid storage assembly, comprising a water storage part and a liquid storage part, wherein the water storage part is configured to contain clean water, the liquid storage part configured to contain a cleaning liquid; a liquid pumping assembly, comprising a first pump assembly and a second pump assembly, wherein the first pump assembly is fluidly connected to the water storage part for drawing the clean water, and the second pump assembly is fluidly connected to the liquid storage part for drawing the cleaning liquid; an execution unit, comprising a heating assembly and a nozzle, wherein the heating assembly is fluidly connected to the first pump assembly for heating the clean water received from the first pump assembly to generate steam, the nozzle is installed on the housing, and the nozzle is configured to be internally hollow to form a channel; and a control assembly configured to be electrically connected to the first pump assembly and the heating assembly to control on/off of the two.

The nozzle is fluidly connected to the heating assembly and the second pump assembly respectively, the channel is configured to allow steam generated by the heating assembly to enter the channel to be sprayed out from a spray orifice, or to enable the steam generated through the heating assembly and the cleaning liquid drawn through the second pump assembly to mix within the channel, forming a mixed fluid to be sprayed out from the spray orifice; and the second pump assembly comprises a pressing handle and a piston pump, the pressing handle is manually operated by a user and abuts against the piston pump to drive the piston pump to quantitatively draw the cleaning liquid from the liquid storage part and deliver the cleaning liquid to the nozzle.

The beneficial effects of the present disclosure compared to the prior art are as follows:

Through the pressing buckle-type quick-release structure of the water storage part, the water storage part and the housing can be quickly disassembled and assembled without tools, facilitating the user to add clean water and perform internal cleaning and maintenance of the water storage chamber, while ensuring the stability of the connection between the water storage part and the housing, meeting the cleaning needs of various scenarios such as household and commercial use; through the quantitative output structure of the piston pump component in the liquid pumping assembly, combined with the "dual-channel convergence" channel of the nozzle, precise quantitative output of the cleaning liquid is achieved, and it can fully mix with the high-temperature steam generated by the heating assembly inside the nozzle, utilizing high temperature to activate the active ingredients of the cleaning liquid, greatly improving the overall stain removal efficiency and cleaning effect; through the detachable nozzle head design of the nozzle, suitable types such as crevice nozzle heads, brush nozzle heads, and flat nozzle heads can be quickly replaced according to different needs like crevice cleaning, large-area flat surface cleaning, and stubborn stain cleaning, enhancing the targeting and flexibility of cleaning operations; through the intelligent touch screen and multi-gear adjustment structure of the control assembly, visual display of statuses such as equipment operating gear, steam temperature, and water/liquid remaining amount is achieved, while supporting multi-mode touch adjustment like gear 1, gear 2, and intensive cleaning gear, with intuitive and convenient operation, accurately matching the intensity requirements of different cleaning scenarios; the compact layout of each component and simple connection methods such as buckles, embedding, and bolts simplify the overall production and assembly process of the equipment, the integrated functional design reduces the number of parts, lowers production and later maintenance costs, while the compact spatial layout enhances the portability of the equipment, balancing usage stability and economy, conducive to large-scale promotion in various scenarios in the civil cleaning field.

BRIEF DESCRIPTION OF DRAWINGS

The drawings, which form a part of this application, are provided to further illustrate the present disclosure. The illustrative embodiments of the present disclosure and the descriptions thereof are used to explain the present disclosure and do not constitute an undue limitation of the present disclosure. In the drawings.

Figure 1:
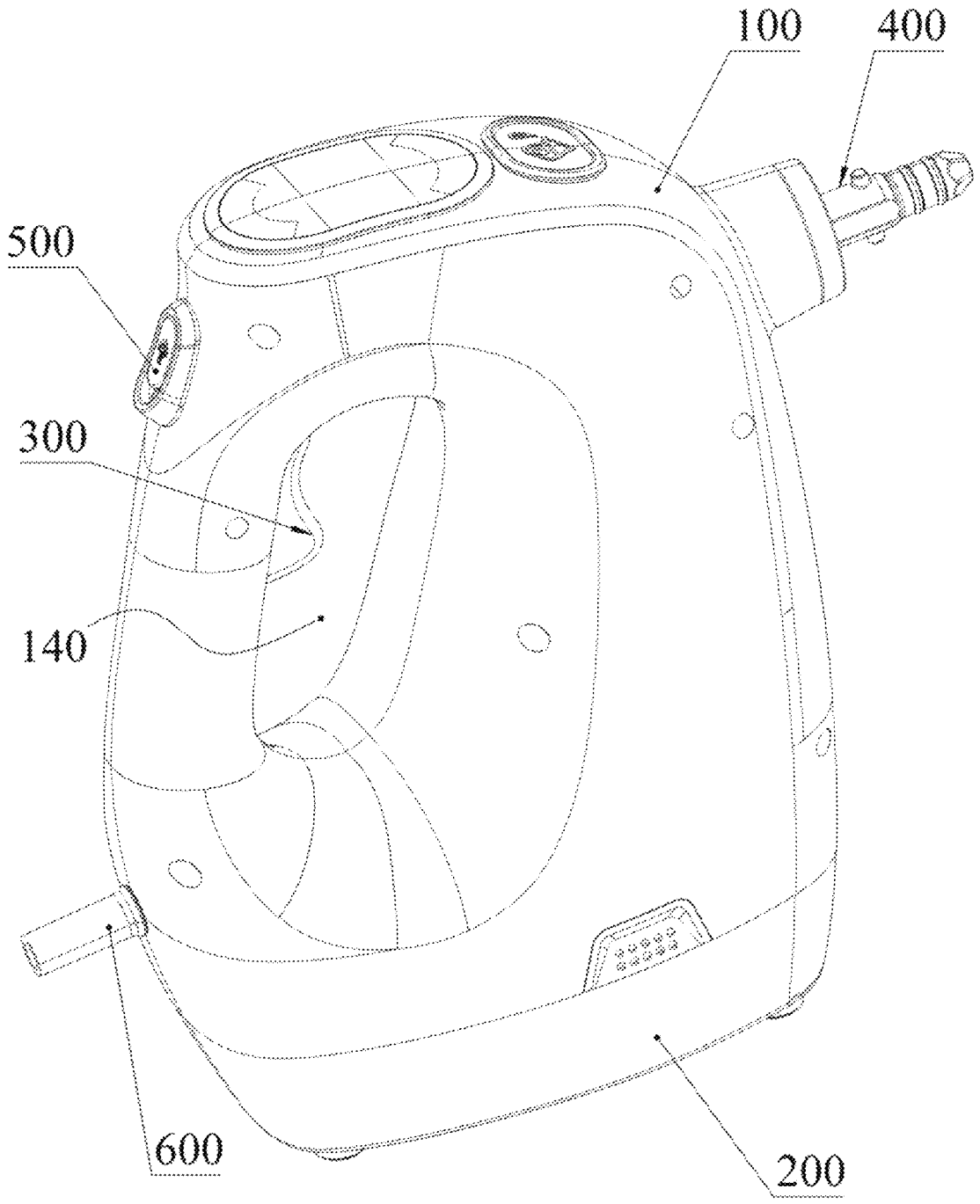
FIG. 1 is a perspective view of an embodiment provided by the present disclosure.

Reference signs: Housing (100); Upper Housing (110); Connecting Protrusion (111); Lower Housing (120); Connecting Groove (121); Accommodating Chamber (130); Grip Part (140); Buckle Groove (150); Mounting Hole (160); Liquid Storage Assembly (200); Water Storage Part (210); Water Storage Chamber (211); Buckle (212); Elastic Member (213); Water Filling Port (214); Dust Cover (215); Water Storage Chamber Water Outlet (216); Liquid Storage Part (220); Liquid Storage Chamber (221); Liquid Filling Port (222); Sealing Cover (223); Liquid Storage Part Liquid Outlet (224); Liquid Pumping Assembly (300); First Pump Assembly (310); First Pump Assembly Mounting Bracket (311); First Pump Assembly Water Inlet (312); First Pump Assembly Water Outlet (313); Second Pump Assembly (320); Pressing Handle (321); Hinge Shaft (3211); Piston Pump (322); Piston Pump Contact End (3221); Piston Pump Liquid Inlet (3222); Piston Pump Liquid Outlet (3223); Execution Unit (400); Heating Assembly (410); Heating Assembly Water Inlet (411); Heating Assembly Steam Outlet (412); Insulating Shell (413); Heating Chamber (414); Nozzle (420); Spray Orifice (421); Nozzle Steam Inlet (422); Mounting Post (423); Nozzle Liquid Inlet (424); Channel (425); Control Assembly (500); Control Screen (510); Control Button (520); Circuit Board (530); Power Interface (600); Dust Sleeve (610).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, equipment, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

In the present disclosure, addressing the technical issue in existing cleaning products where cleaning liquid is often directly squeezed out for use and cannot synergize with high-temperature steam to fully exert cleaning efficacy, a steam cleaner is provided, comprising a coordinated structure of a housing, a liquid storage assembly, a liquid pumping assembly, an execution unit, a control assembly and a power assembly. The liquid storage assembly includes a water storage part and a liquid storage part, which respectively contain clean water and cleaning liquid; the liquid pumping assembly draws clean water through a first pump assembly and quantitatively draws cleaning liquid through a piston pump assembly. After the clean water is heated by a heating assembly to generate high-temperature steam, it is mixed with the cleaning liquid inside a nozzle and is sprayed out, utilizing the high-temperature steam to activate the cleaning liquid's effectiveness, significantly improving stain removal efficiency and cleaning results. Meanwhile, structures such as the press-type buckle quick-release structure of the water storage part, the insulating shell of the heating assembly, the detachable nozzle head of the nozzle, and the smart touch control of the control assembly further enhance usability, safety, and operational experience. This effectively resolves the technical shortcomings of existing cleaning products, which cannot achieve synergistic spraying of cleaning liquid with high-temperature steam and thus have insufficient cleaning effects. The specific implementation of the steam cleaner of the present disclosure is described in detail below with reference to the drawings.

Figure 2:
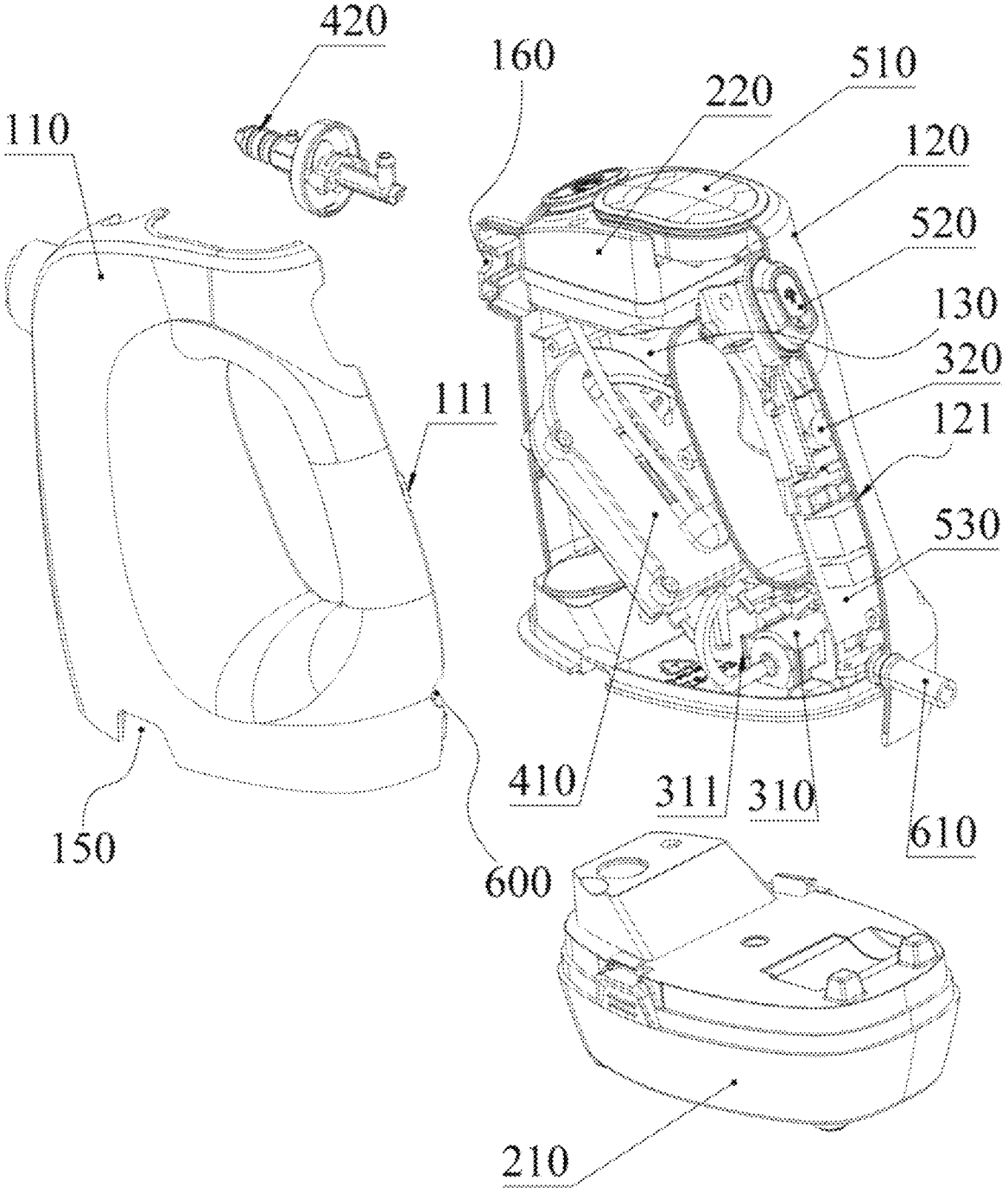
FIG. 2 is an exploded view of the housing of the embodiment in FIG. 1.

As shown in FIGS. 1 and 2, the present disclosure provides a steam cleaner, comprising a housing 100, a liquid storage assembly 200, a liquid pumping assembly 300, an execution unit 400, and a control assembly 500. The housing 100 includes an upper housing 110 and a lower housing 120 that is symmetrically arranged and fully compatible with the upper housing 110. Both are uniformly provided with multiple bolt mounting positions along their mating edges, and are fixedly connected by a detachable bolt structure passing through each mounting position. On the upper housing 110, at the mating surface with the lower housing 120, there is a connecting protrusion 111. Correspondingly, on the mating surface of the lower housing 120, there is a connecting groove 121. When assembling the housing 100, the connecting groove 121 guides the connecting protrusion 111, facilitating the quick mating and installation of the upper housing 110 with the lower housing 120, while ensuring the stability and sealing of their connection. The upper housing 110 and the lower housing 120 enclose to form a hollow accommodating chamber 130, which is used to centrally accommodate and position functional components such as the liquid storage assembly 200, liquid pumping assembly 300, execution unit 400, and control assembly 500, preventing displacement of the components during equipment operation. Additionally, the housing 100 is integrally formed with an ergonomically designed grip part 140 in the central area of its main body. The shape of the grip part 140 is adapted to the human hand's gripping posture, making it easy for users to hold steadily to operate the entire machine and improving comfort during prolonged use.

Figure 3:
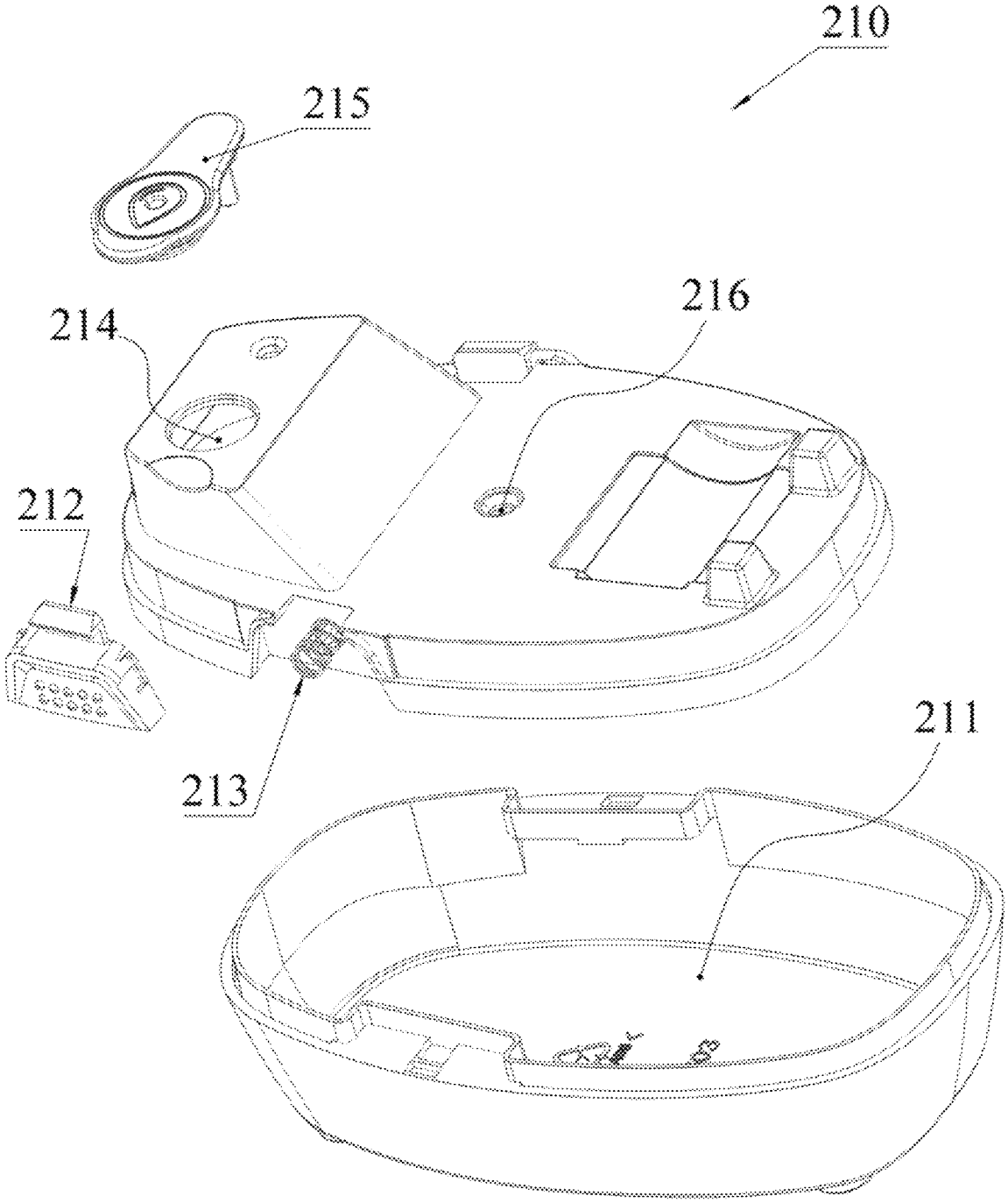
FIG. 3 is an exploded view of the water storage part of the embodiment shown in FIG. 1.

As shown in FIGS. 2 and 3, the liquid storage assembly 200 includes a water storage part 210 and a liquid storage part 220. The water storage part 210 forms a water storage chamber 211 for accommodating clean water. This water storage chamber 211 is located in the bottom area of the accommodating chamber 130 of the housing 100. A press-type buckle-type quick-release structure is arranged between the water storage part 210 and the housing 100, connecting the water storage part 210 to the bottom of the housing 100. Specifically, the press-type buckle-type quick-release structure includes a buckle 212 fixed to the top of the water storage part 210 and a buckle groove 150 provided at the bottom of the housing 100. The buckle 212 is equipped with an elastic member 213, which in this disclosure is preferably a return spring. When assembling the water storage part 210, align the buckle 212 with the buckle groove 150 and press the water storage part 210 toward the housing 100. The buckle 212 is squeezed by the buckle groove 150, compressing the elastic member 213. Once the buckle 212 is fully embedded in the buckle groove 150, the elastic member 213 rebounds, pushing the buckle 212 to form a tight engagement with the buckle groove 150, thereby achieving quick and secure assembly of the water storage part 210 to the housing 100. When disassembling the water storage part 210, press the buckle 212 to compress the elastic member 213 and disengage it from the buckle groove 150, allowing the water storage part 210 to be quickly removed from the housing 100 for water filling or internal cleaning and maintenance of the water storage chamber 211. This structure ensures the stability of the connection between the water storage part 210 and the housing 100, preventing loosening or displacement during operation, while also enabling quick disassembly and assembly of the water storage part 210, improving convenience. The water storage part 210 is also provided with a water filling port 214, which is equipped with a removable dust cover 215 to prevent external impurities from entering the water storage chamber 211.

In other embodiments (not shown), the fixed connection between the water storage part 210 and the housing 100 is not limited to the buckle-type quick-release structure. For example, a magnetic fixation structure can be used, where a first magnet is embedded at the top of the water storage part 210, and a second magnet is embedded at the corresponding position on the bottom of the housing 100, achieving quick installation and removal of the water storage part 210 through the attraction of opposite poles of the first and second magnets. Alternatively, a twist-lock connection structure can be adopted, where the water storage part 210 is rotated relative to the housing 100 by a certain angle (e.g., 90°), causing the buckle protrusion on the water storage part 210 to lock into or disengage from the spiral buckle groove on the housing 100. These alternative structures also enable quick disassembly and assembly of the water storage part 210 while ensuring connection stability.

Figure 4:
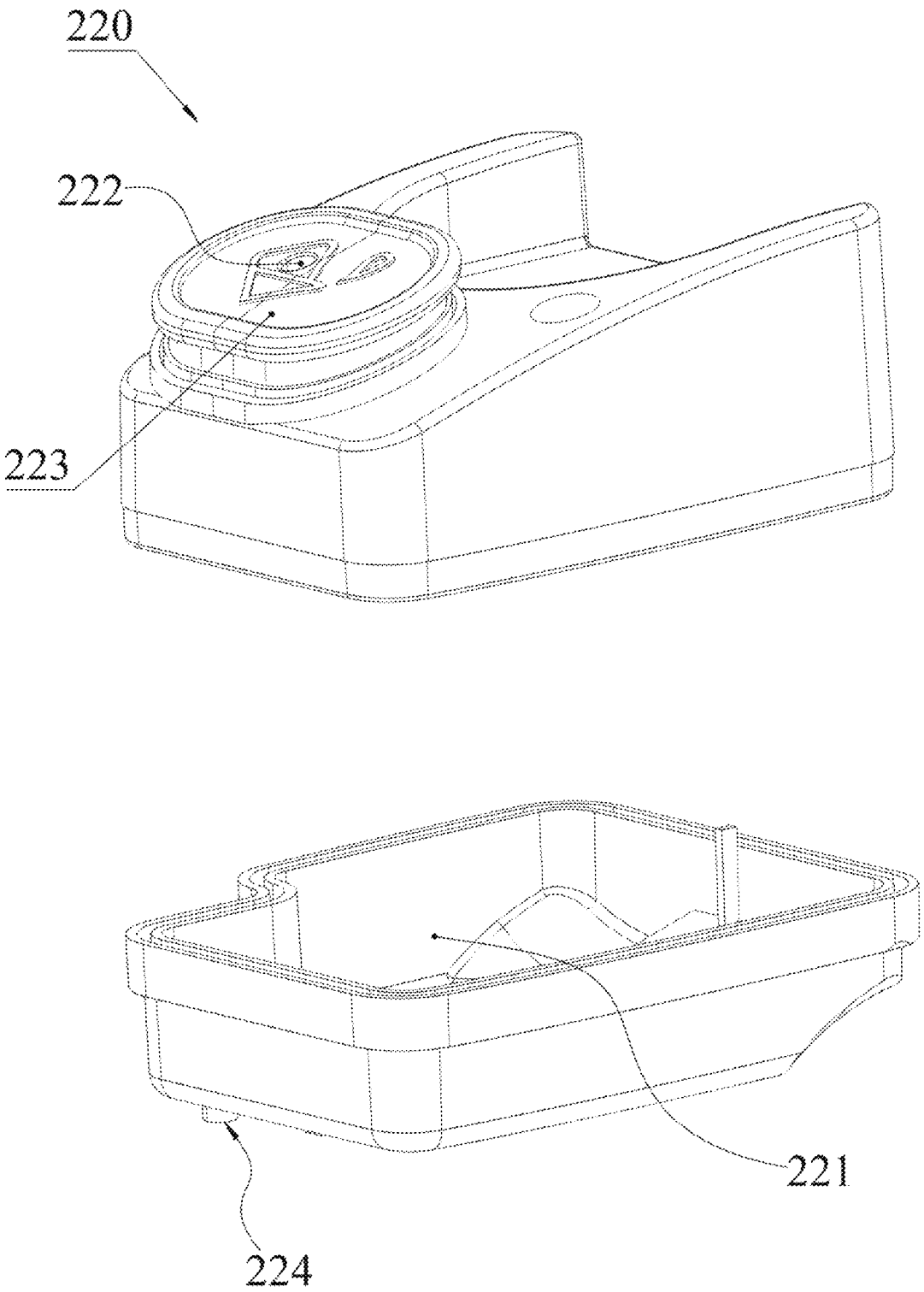
FIG. 4 is an exploded view of the liquid storage part of the embodiment shown in FIG. 1.

Referring to FIGS. 2 and 4, the liquid storage part 220 forms a liquid storage chamber 221 for accommodating cleaning liquid. This liquid storage chamber 221 is located in the upper area of the accommodating chamber 130 of the housing 100, arranged in a vertical partition layout with the water storage chamber 211. The top of the liquid storage part 220 is provided with a liquid filling port 222, which is detachably fixed with a sealing cover 223 to prevent leakage of the cleaning liquid during equipment movement or operation, while facilitating user refilling of the liquid storage chamber 221. The liquid storage chamber 221 and the housing 100 are fixedly connected through embedded assembly (this method is prior art and will not be elaborated here).

Figure 5:
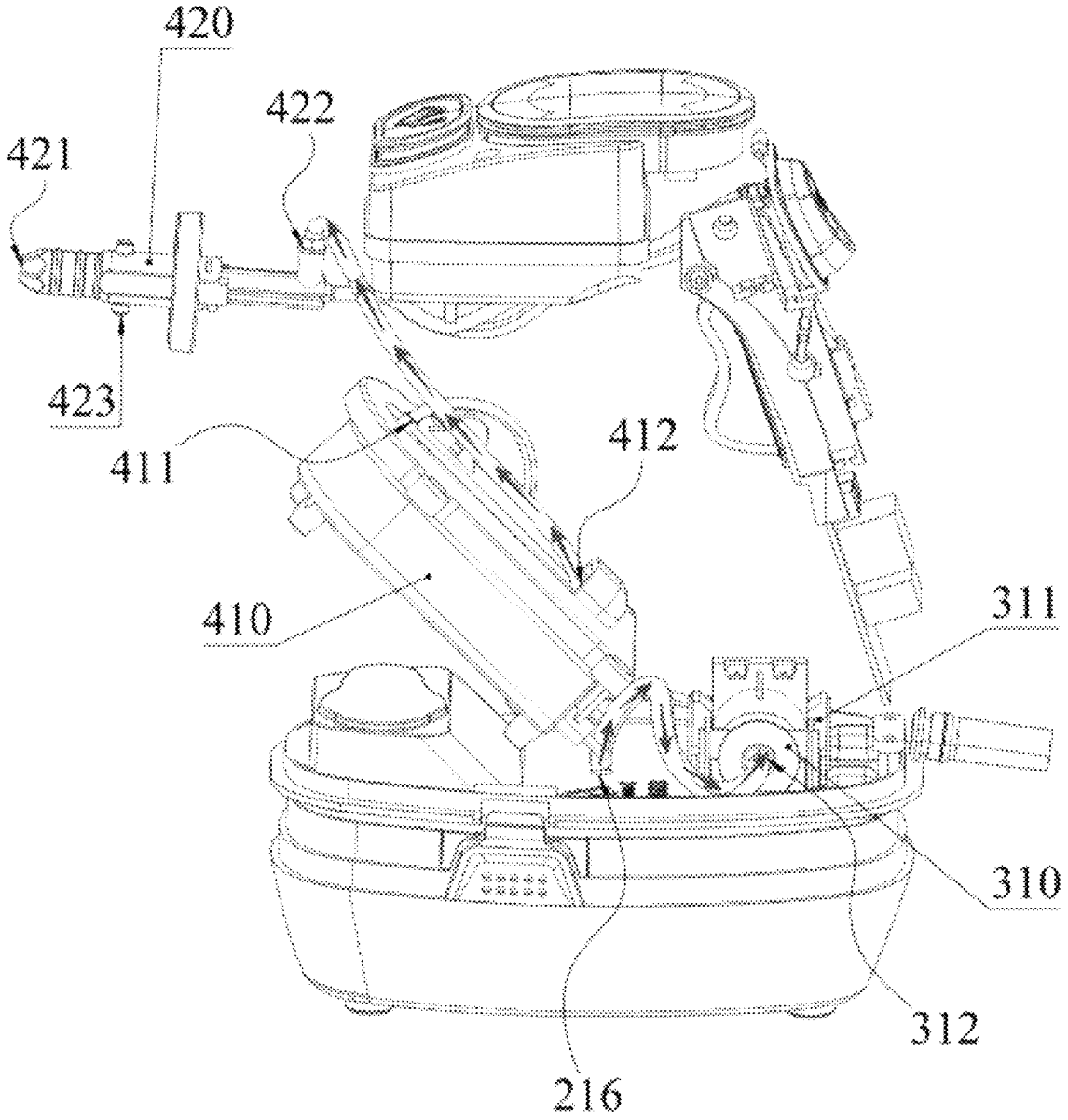
FIG. 5 is a perspective view of the internal structure of the embodiment shown in FIG. 1.
Figure 6:
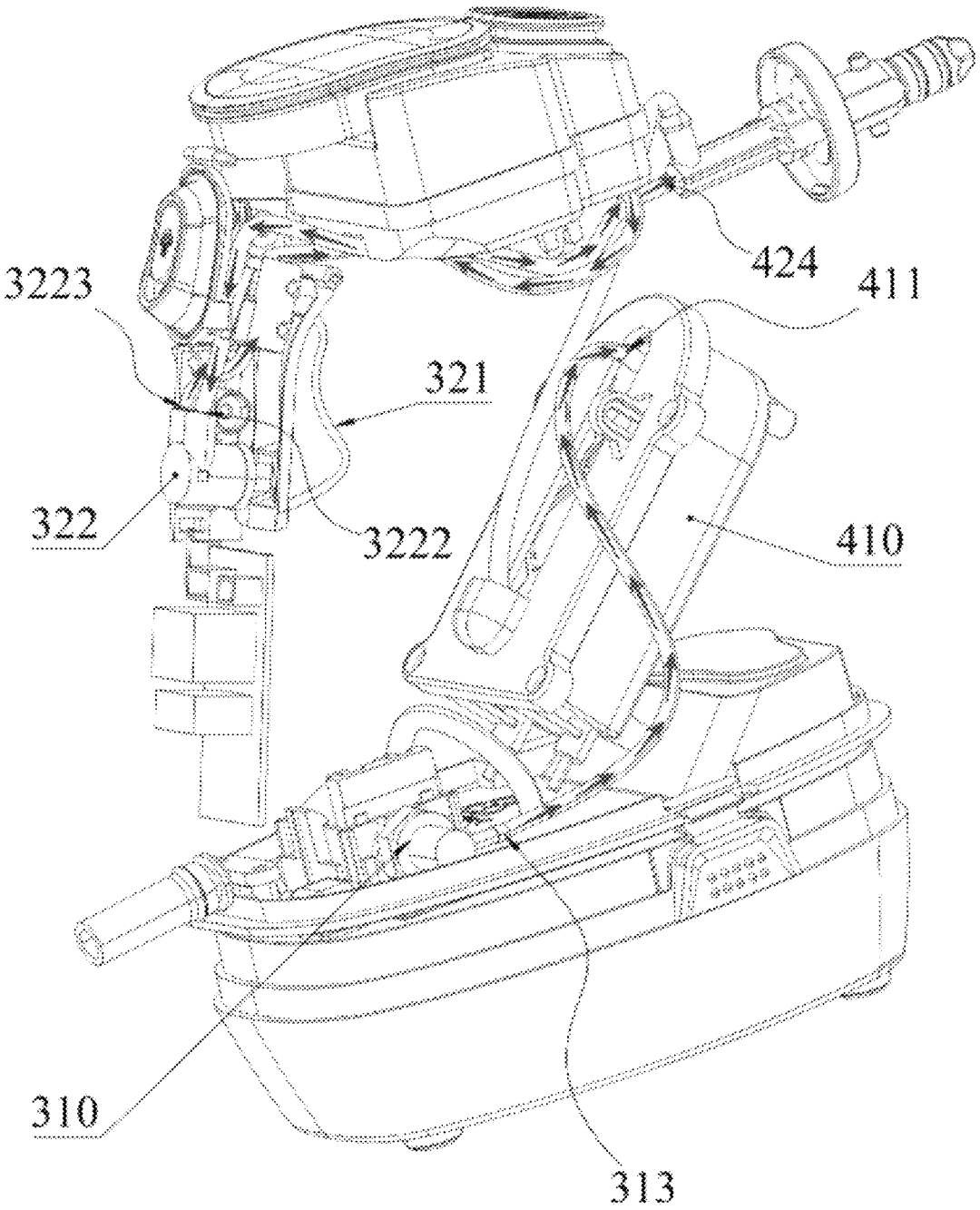
FIG. 6 is another perspective view of the internal structure of the embodiment shown in FIG. 5.
Figure 7:
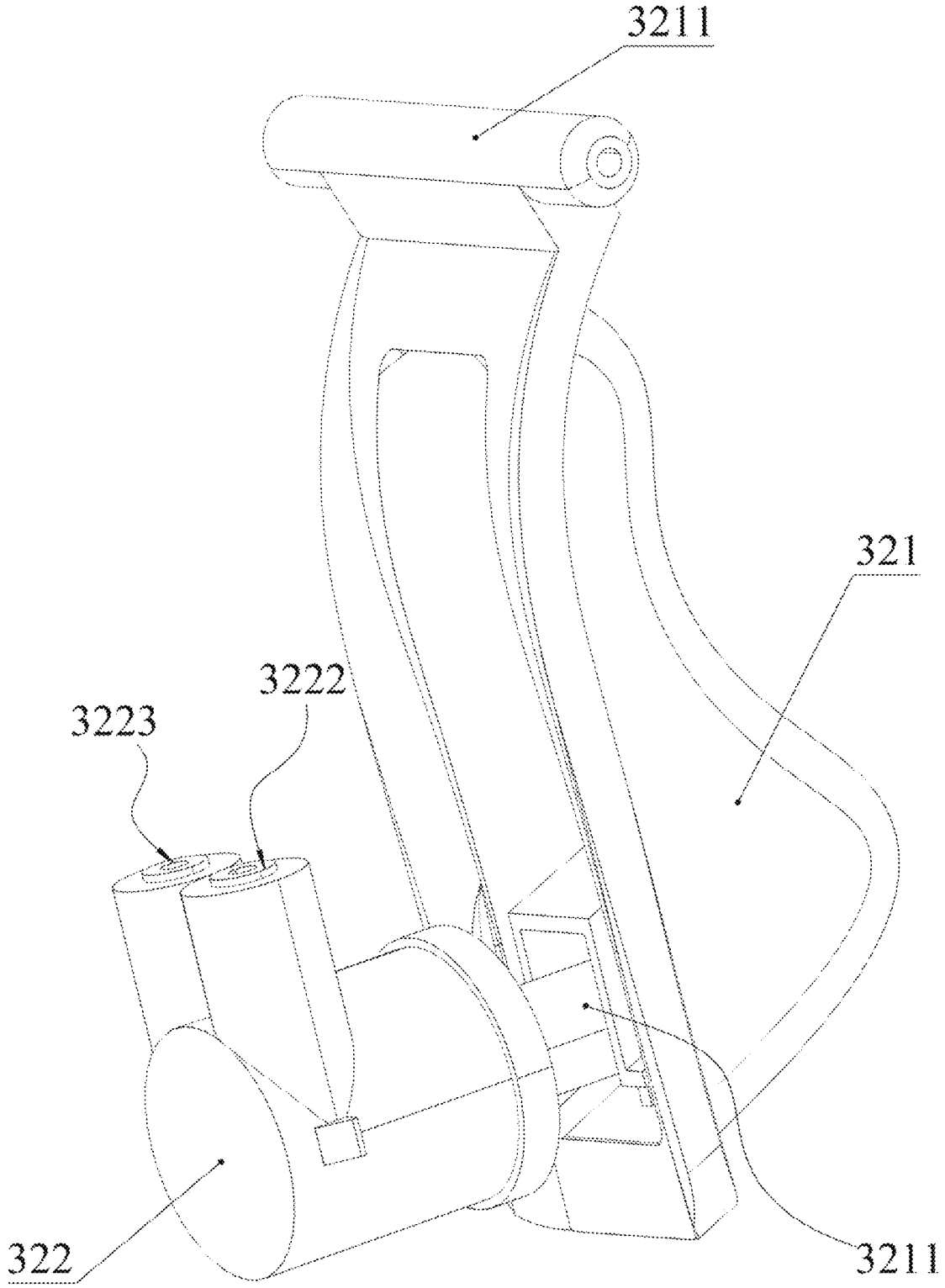
FIG. 7 is a connection diagram of the pressing handle and the piston pump of the embodiment shown in FIG. 6.
Figure 8:
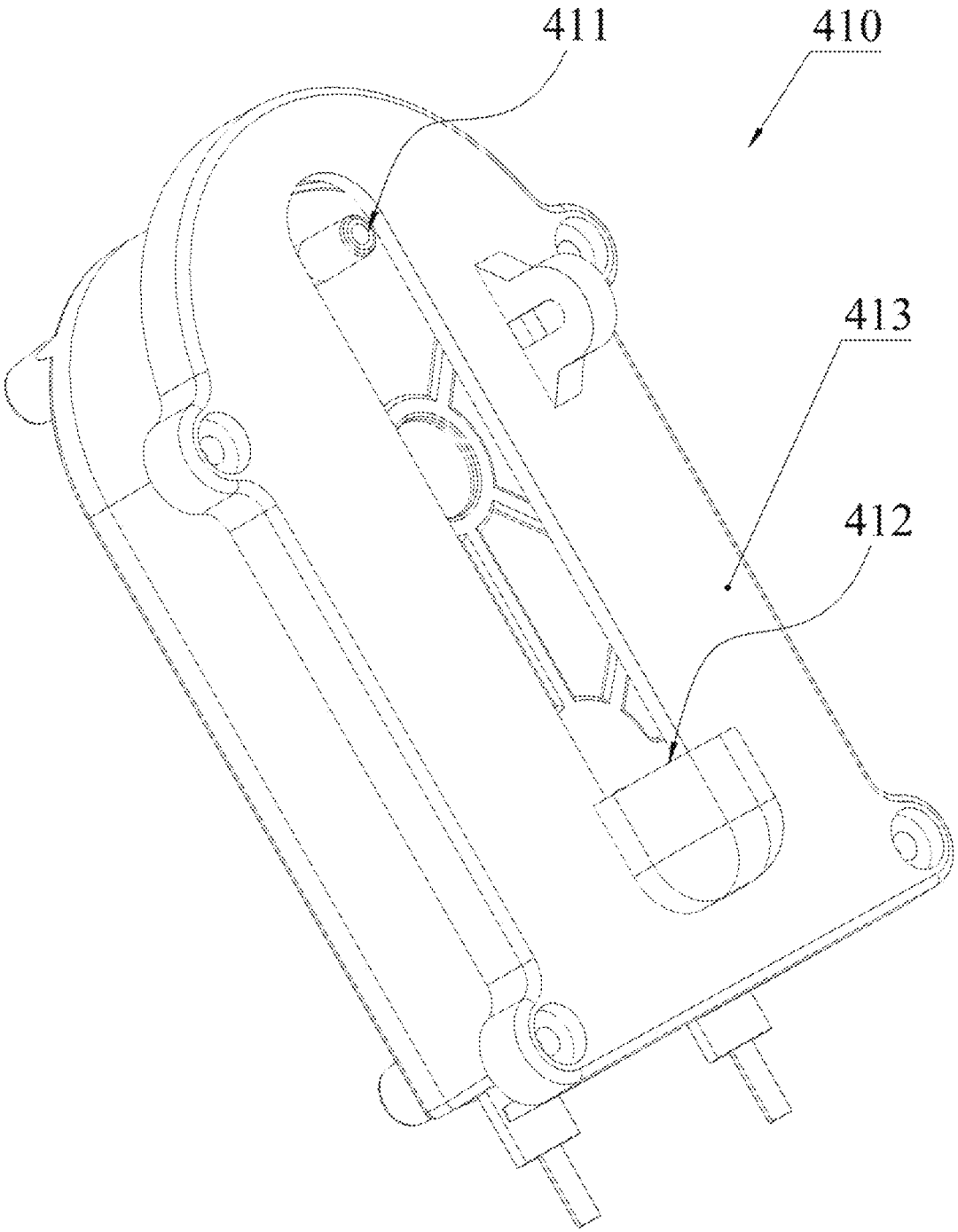
FIG. 8 is a perspective view of the heating assembly of the embodiment shown in FIG. 1.

As shown in FIGS. 2 and 5, the liquid pumping assembly 300 is arranged inside the accommodating chamber 130 of the housing 100. It includes a first pump assembly 310 and a first pump assembly mounting bracket 311 for securing the first pump assembly 310. The first pump assembly 310 is positioned above and adjacent to the water storage part 210. The first pump assembly mounting bracket 311 is integrally formed and fixed to the housing 100 to ensure the first pump assembly 310 does not shift during equipment operation. The first pump assembly 310 is a water pump used to draw clean water from the water storage chamber 211. Specifically, the input end of the first pump assembly 310 has a first pump assembly water inlet 312, and the output end has a first pump assembly water outlet 313. Correspondingly, the water storage part 210 is provided with a water storage chamber water outlet 216. The first pump assembly water inlet 312 and the water storage chamber water outlet 216 are sealed with a corrosion-resistant silicone tube, reinforced with anti-slip clamps to enhance connection reliability and effectively prevent leakage during clean water transport.

As shown in FIGS. 1, 2, 5, 6, and 8, the execution unit 400 includes a heating assembly 410 and a nozzle 420, wherein the heating assembly 410 is arranged in the central area of the accommodating chamber 130, between the first pump assembly 310 and the nozzle 420. An insulating shell 413 is fixedly installed on the outer wall of the heating assembly 410, which effectively blocks the high temperature generated during operation of the heating assembly 410 from transferring to the housing 100, preventing burns when held by the user. A sealed heating chamber 414 is provided inside the heating assembly 410 (refer to FIG. 9), and a PTC ceramic heating element is fixedly installed in the heating chamber 414 as the core heating component. The top of the heating assembly 410 is correspondingly provided with a heating assembly water inlet 411, and the bottom is provided with a heating assembly steam outlet 412. The first pump assembly 310 and the execution unit 400 are connected through a high-temperature resistant silicone tube. One end of the high-temperature resistant silicone tube is sealingly sleeved with the first pump assembly water outlet 313, and the other end is fixedly connected to the heating assembly water inlet 411 of the heating assembly 410 in the execution unit 400. The high-temperature resistant silicone tube is routed along the inner wall of the accommodating chamber 130 to prevent loosening or tangling of the pipeline during equipment operation or movement.

In other embodiments, the heating assembly 410 can also use a metal tubular heater according to different power and response speed requirements. It is made by encapsulating a resistance wire in a metal sheath and filling it with an insulating thermal conductive medium, featuring high power density and fast heating speed. Alternatively, in scenarios requiring instant steam, an instant boiler structure can be adopted, allowing water to vaporize instantly when flowing over a high-temperature heating surface. These alternative heating solutions can efficiently convert clean water into high-temperature steam.

Please continue to refer to FIGS. 2 and 5. The front end of the housing 100 is provided with a mounting hole 160. The nozzle 420 is embedded and fixed into the mounting hole 160. The end of the nozzle 420 extending outside the housing 100 is the spray orifice 421. The other end of the nozzle 420, away from the spray orifice 421, is provided with a nozzle steam inlet 422. The nozzle 420 is configured as an elongated shape, with a hollow interior forming a channel 425 (see FIG. 9). The spray orifice 421 is conical, allowing for the installation of different types of spray heads with various spray orifices based on cleaning requirements. Specifically, the nozzle 420 also includes a mounting post 423 on its surface for fixedly mounting a replaceable spray head. Depending on the cleaning scenario, the spray head can be designed as a crevice spray head, a brush spray head, a flat spray head, among other types; their outer walls are all provided with mounting grooves. During installation, align the mounting groove of the spray head with the mounting post 423 on the surface of the nozzle 420 and then rotate, allowing the mounting post 423 to be detachably snapped and fixed into the mounting groove of the spray head, enabling quick replacement and locking of the spray head. The heating assembly steam outlet 412 and the nozzle steam inlet 422 are sealingly connected through a section of high-temperature resistant silicone braided tube. The outer layer of this tube is wrapped with a heat-insulating braided layer, providing good flexibility, high-temperature resistance, and thermal insulation properties.

As shown in FIGS. 2, 4, 6, and 7, in addition to the above structures, to achieve the extraction of cleaning liquid from the liquid storage chamber 221 to the nozzle 420, the liquid pumping assembly 300 of the present disclosure further includes a second pump assembly 320 for extracting the cleaning liquid, which comprises a pressing handle 321 and a piston pump 322 in contact with the pressing handle 321. The pressing handle 321 is manually operated by the user and abuts against the piston pump 322. Specifically, the pressing handle 321 is provided with a hinge shaft 3211, through which it is hinged to the housing 100, and extends to the inner side of the grip part 140, adapting to the finger operation posture when the user holds the equipment, facilitating the triggering of cleaning liquid output at any time. The piston pump 322 is the core driving component, internally equipped with a piston, return spring, and check valve structure (this structure is prior art and will not be detailed here). The power input end of the piston pump 322 has a contact end 3221, which abuts against the inner wall of the pressing handle 321, forming a linkage cooperation. The piston pump 322 also includes a piston pump liquid inlet 3222 and a piston pump liquid outlet 3223. Correspondingly, the bottom of the liquid storage part 220 is provided with a liquid storage part liquid outlet 224, and the nozzle 420 near the nozzle steam inlet 422 is also provided with a nozzle liquid inlet 424. The piston pump liquid inlet 3222 is sealingly connected to the liquid storage part liquid outlet 224 at the bottom of the liquid storage part 220 through a section of corrosion-resistant silicone tube, with a sealing gasket at the connection to enhance leak resistance; the piston pump liquid outlet 3223 is sealingly connected to the nozzle liquid inlet 424 of the nozzle 420 through another section of corrosion-resistant silicone tube. When the user presses the pressing handle 321, it drives the piston pump contact end 3221 to move, thereby activating the reciprocating motion of the piston inside the piston pump 322, sucking the cleaning liquid from the liquid storage chamber 221 through the liquid storage part liquid outlet 224 and the piston pump liquid inlet 3222, and then delivering it through the piston pump liquid outlet 3223 and the corrosion-resistant silicone tube to the nozzle liquid inlet 424, achieving quantitative spraying of the cleaning liquid. It should be noted that the channel 425 of the nozzle 420 forms a "dual-path convergence" structure: high-temperature steam from the nozzle steam inlet 422 and cleaning liquid from the nozzle liquid inlet 424 fully mix in the mid-section convergence area of the channel 425, and the mixed steam containing cleaning liquid is sprayed out through the spray orifice 421, significantly enhancing the cleaning effect by leveraging the dissolving action of high-temperature steam and the cleaning performance of the cleaning liquid.

Figure 9:
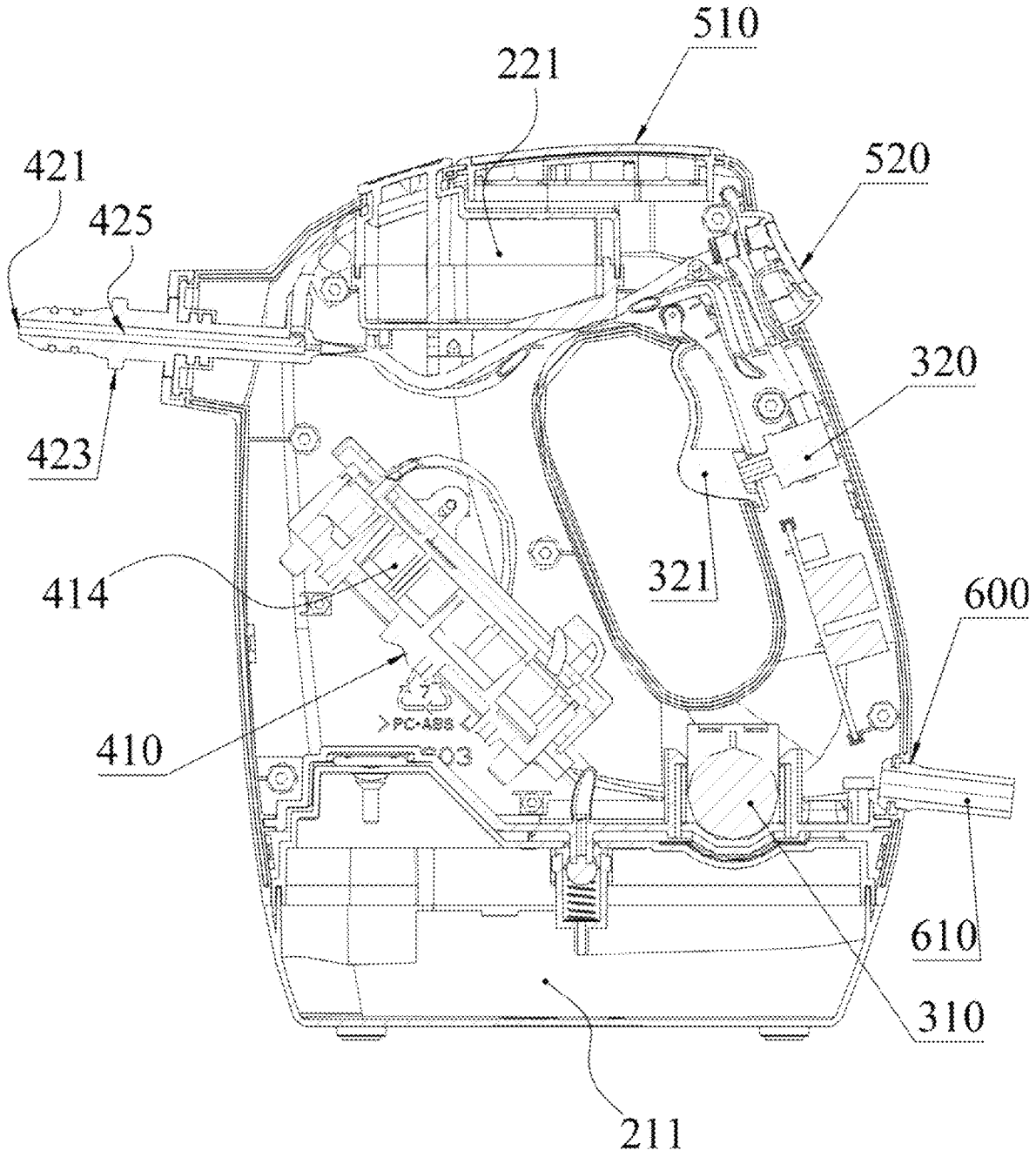
FIG. 9 is a cross-sectional view of the embodiment shown in FIG. 1.

As shown in FIGS. 1, 2, and 9, the control assembly 500 is configured to be electrically connected to the first pump assembly 310 and the heating assembly 410 to control their on/off states. It includes a control screen 510 embedded at the top of the housing 100, which utilizes capacitive touch technology and integrates display and interaction functions. It can selectively display status information such as equipment operating gear, steam temperature, and water/liquid remaining amount, while also supporting touch selection of cleaning mode and start/stop of the equipment by the user. The control screen 510 is equipped with a power button, gear 1 button, gear 2 button, and intensive cleaning button. Among these, the power button is used for power control of the equipment, appearing red when power is connected, and turning to blue blinking upon click to enter the startup phase (e.g., the power button is set to stay lit 15 seconds after power connection, indicating the equipment is operational). The gear 1 and gear 2 buttons correspond to cleaning modes with different airflow rates and temperatures (e.g., their respective modes can be set as: gear 1: airflow rate 33±3 g/min, temperature 95-105° C.; gear 2: airflow rate 40±3 g/min, temperature 95-105° C.). The intensive cleaning button corresponds to a mode with airflow rate 50±5 g/min and temperature 75-85° C., used for cleaning nozzle and pipeline residual cleaning liquid. The control assembly 500 also includes a control button 520, which is a press-slide type latch structure located on the outer wall of the housing 100. After selecting a gear, sliding it downward locks to initiate steam ejection; releasing or performing other operations stops steam ejection, ensuring operational safety. Additionally, the control assembly 500 includes a circuit board 530 installed in the accommodating chamber 130 of the housing 100. This circuit board 530 is electrically connected through wires to functional components such as the touch control screen 510, control button 520, first pump assembly 310, and heating assembly 410, and is used to receive and parse user operation commands, send control signals to execution components, and display equipment status in real time on the screen.

In a preferred embodiment of the present disclosure, to achieve flexible switching between two operating modes of pure steam and mixed cleaning liquid steam, the nozzle 420 is respectively in fluid communication with the heating assembly steam outlet 412 of the heating assembly 410 and the piston pump liquid outlet 3223 of the second pump assembly 320. The hollow channel 425 inside the nozzle is configured to have two operating paths: first, it allows pure high-temperature steam generated by the heating assembly 410 to enter the channel 425 through the nozzle steam inlet 422 and be directly ejected from the front spray orifice 421, suitable for scenarios such as high-temperature sterilization and dissolving oil stains; second, when the user activates the second pump assembly 320, the channel 425 enables high-temperature steam generated by the heating assembly 410 to meet, collide, and fully mix with the cleaning liquid quantitatively drawn by the second pump assembly 320 within the channel 425, forming a mixed fluid with suitable temperature and concentration, which is finally ejected from the spray orifice 421 in an atomized or jet form. This design leverages the energy of the high-temperature steam to greatly activate the chemical activity of the cleaning liquid, thereby achieving synergistic multiplication of cleaning efficacy.

In other embodiments (not shown), the second pump assembly 320 used for drawing the cleaning liquid in the present disclosure is not limited to the manually operated piston pump 322. The second pump assembly 320 can also be a miniature electric diaphragm pump or a peristaltic pump. When a miniature electric diaphragm pump is used, it receives control signals through the circuit board 530 and is driven by a motor for reciprocating diaphragm motion to achieve electric quantitative delivery of the cleaning liquid, which can be triggered by the user through the control screen 510 or a light-touch switch. When a peristaltic pump is used, it quantitatively delivers the cleaning liquid from the liquid storage chamber 221 to the nozzle 420 by squeezing a corrosion-resistant silicone tube with rollers; this method keeps the cleaning liquid completely isolated from the pump body, avoiding cross-contamination and corrosion. These electric pumping solutions provide feasibility for automated operation.

As shown in FIG. 9, the steam cleaner of the present disclosure further includes a power interface 600, which can accommodate a power cord for connecting to an external power supply to power the equipment. It is located on the outer wall at the rear of the housing 100, adopting a standard power plug adapter structure, and the power cord can be electrically connected to the circuit board 530 inside the equipment through this interface. A dust sleeve 610 is configured at the power interface 600 to prevent dust and moisture from entering the interface and causing short circuits or poor contact, ensuring electrical safety of the equipment. When the equipment needs to operate, the user inserts the power cord into an external power socket to supply power to electrical components such as the control assembly 500, the first pump assembly 310, and the heating assembly 410, enabling normal startup and operation of the equipment.

In another embodiment, the power supply and control method of the steam cleaner can be further extended. A rechargeable battery pack (such as a lithium battery) can be installed inside the housing 100, eliminating the constraint of the power cord to enable wireless operation and improve portability. Correspondingly, the power interface 600 can be replaced with a wireless charging receiver coil for charging the battery pack. In terms of control, the control assembly 500 can be further integrated with a wireless communication module (such as Wi-Fi or Bluetooth module), allowing users to remotely operate the equipment, set modes, and monitor status through an application on a smart terminal, achieving intelligent management.

The working principle of the present disclosure is as follows: First, after the user connects the power cord to an external power source, the power button on the control screen 510 turns red; after clicking the power button, the equipment enters the startup phase (the power button flashes blue, and remains steady after about 15 seconds), at which point the equipment becomes operational. Once the power button is steady, the user selects a cleaning level (level 1, level 2, or intensive cleaning level) through the control screen 510. If the control button 520 is not slid down and locked at this time, the equipment only completes level selection and will not initiate steam output. After the user slides and locks the control button 520, the circuit board 530 of the control assembly 500 sends a start signal to the first pump assembly 310 of the liquid pumping assembly 300. The first pump assembly 310 draws clean water from the water storage chamber 211 of the water storage part 210, pressurizes it, and delivers it through a high-temperature resistant silicone tube to the heating assembly 410 of the execution unit 400. The PTC ceramic heating element inside the heating assembly 410 heats the water according to the command of the circuit board 530, producing high-temperature steam corresponding to the selected level; the high-temperature steam is delivered through the heating assembly steam outlet 412 and a high-temperature resistant silicone braided tube to the nozzle steam inlet 422 of the nozzle 420. Simultaneously, if the user wishes to use a steam cleaning mode with cleaning liquid, they can press the pressing handle 321 inside the grip part 140. The pressing handle 321 rotates around the hinge shaft 3211 and drives the piston pump contact end 3221 of the piston pump 322, thereby activating the reciprocating motion of the piston inside the piston pump 322. This draws cleaning liquid from the liquid storage chamber 221 of the liquid storage part 220 through the liquid storage part liquid outlet 224 and a corrosion-resistant silicone tube into the piston pump 322, then delivers it through the piston pump liquid outlet 3223 and a corrosion-resistant silicone tube to the nozzle liquid inlet 424 of the nozzle 420. The channel 425 inside the nozzle 420 forms a "dual-path convergence" structure, where the high-temperature steam from the nozzle steam inlet 422 and the cleaning liquid from the nozzle liquid inlet 424 fully mix in the mid-section convergence area of the channel 425. Finally, the mixed steam containing cleaning liquid is ejected through the spray orifice 421 of the nozzle 420, achieving the cleaning operation. After cleaning, the user can click the intensive cleaning button on the control screen 510 while keeping the control button 520 locked; the equipment will continuously output steam at a rate of 50±5 g/min and a temperature of 75-85° C. for 1-2 minutes to expel residual cleaning liquid from the nozzle and connecting tubes. If the control button 520 is released, or if the level button or power button is operated again, the circuit board 530 will sequentially stop the first pump assembly 310 and the heating assembly 410, and the equipment's steam output, liquid pumping, and heating functions will cease in order, completing one cleaning operation.

In summary, the present disclosure achieves the following technical effects: through the press-type buckle-type quick-release structure of the water storage part 210, the water storage part and the housing can be quickly disassembled and assembled without tools, facilitating user water refilling and internal cleaning maintenance of the water storage chamber, while ensuring the stability after connection of the water storage part and the housing, meeting the cleaning needs of various scenarios such as household and commercial use; through the quantitative output structure of the piston pump assembly 322 in the liquid pumping assembly 300, cooperating with the "dual-channel convergence" channel 425 of the nozzle 420, precise quantitative output of cleaning liquid is achieved, and it can fully mix with the high-temperature steam generated by the heating assembly inside the nozzle, utilizing high temperature to activate the active ingredients of the cleaning liquid, significantly improving overall stain removal efficiency and cleaning effect; through the detachable nozzle design of the nozzle 420, suitable types such as crevice nozzles, brush nozzles, and flat nozzles can be quickly replaced according to different needs like crevice cleaning, large-area surface cleaning, and stubborn stain cleaning, enhancing the targeting and flexibility of cleaning operations; through the smart touch screen and multi-gear adjustment structure of the control assembly 500, visual display of statuses such as equipment operating gear, steam temperature, and water/liquid remaining amount is achieved, while supporting multi-mode touch adjustment like gear 1, gear 2, and intensive cleaning gear, with intuitive and convenient operation, accurately matching the intensity requirements of different cleaning scenarios; the compact layout of each component and simple connection methods such as buckles, embedding, and bolts simplify the overall production and assembly process of the equipment, and the integrated functional design reduces the number of parts, lowering production and later maintenance costs, while the compact spatial layout enhances equipment portability, balancing usage stability and economy, facilitating large-scale promotion in various scenarios in the civil cleaning field.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A steam cleaner, comprising:

a housing;

a liquid storage assembly, comprising a water storage part and a liquid storage part, wherein the water storage part is configured to contain clean water, and the liquid storage part is configured to contain a cleaning liquid;

a liquid pumping assembly, comprising a first pump assembly and a second pump assembly, wherein the first pump assembly is fluidly connected to the water storage part for drawing the clean water, and the second pump assembly is fluidly connected to the liquid storage part for drawing the cleaning liquid;

an execution unit, comprising a heating assembly and a nozzle, wherein the heating assembly is fluidly connected to the first pump assembly for heating the clean water received from the first pump assembly to generate steam, the nozzle is installed on the housing, and the nozzle is configured to be internally hollow to form a channel; and a control assembly configured to be electrically connected to the first pump assembly and the heating assembly to control on/off of the two;

wherein the nozzle is fluidly connected to the heating assembly and the second pump assembly respectively, the channel is configured to allow steam generated by the heating assembly to enter the channel to be sprayed out from a spray orifice, or to allow the steam generated through the heating assembly and the cleaning liquid drawn through the second pump assembly to mix within the channel, forming a mixed fluid to be sprayed out from the spray orifice.

2. The steam cleaner according to claim 1, wherein the nozzle comprises a nozzle steam inlet, a nozzle liquid inlet and the spray orifice; and the nozzle steam inlet is fluidly connected to the heating assembly to receive the steam, and the nozzle liquid inlet is fluidly connected to the second pump assembly to receive the cleaning liquid.

3. The steam cleaner according to claim 2, wherein the second pump assembly comprises a pressing handle and a piston pump, the pressing handle is manually operated by a user and abuts against the piston pump to drive the piston pump to quantitatively draw the cleaning liquid from the liquid storage part and deliver the cleaning liquid to the nozzle liquid inlet.

4. The steam cleaner according to claim 1, wherein a pressing buckle-type quick-release structure is provided between the water storage part and the housing, the water storage part is detachably installed at a bottom of the housing through the pressing buckle-type quick-release structure; and the pressing buckle-type quick-release structure comprises a buckle fixed to a top of the water storage part, an elastic member assembled on the buckle, and a buckle groove provided at the bottom of the housing; and the buckle is configured to engage with the buckle groove under a return force of the elastic member.

5. The steam cleaner according to claim 1, wherein an insulating shell is fixedly installed on an outer wall of the heating assembly, and a sealed heating chamber is provided inside the heating assembly.

6. The steam cleaner according to claim 1, wherein the control assembly comprises a control screen configured to display at least one type of status information among equipment operating gear, steam temperature, and water/liquid remaining amount, and to receive a touch input from the user to select a cleaning mode.

7. The steam cleaner according to claim 6, wherein the control assembly further comprises a control button and a circuit board, the control button is a press-slide type latch structure configured to continuously activate steam ejection after the user performs a slide-down locking operation and to stop ejection upon release of latching; and the circuit board is electrically connected to the control screen, the control button, the first pump assembly and the heating assembly through wires.

8. The steam cleaner according to claim 1, wherein the housing comprises an upper housing and a lower housing, and a connecting protrusion and a connecting groove are respectively provided at mating surfaces of the upper housing and the lower housing; and the connecting protrusion and the connecting groove are fixedly connected by a detachable bolt structure and enclose to form a hollow accommodating chamber.

9. The steam cleaner according to claim 1, wherein the water storage part is provided with a water filling port, and a dust cover is detachably provided at the water filling port; and the liquid storage part is provided with a liquid filling port, and a sealing cover is detachably provided at the liquid filling port to prevent leakage of the cleaning liquid.

10. The steam cleaner according to claim 1, further comprising a power interface configured for installing a power cord and connecting to an external power source to supply power to the control assembly, the first pump assembly and the heating assembly.

11. A steam cleaner, comprising:

a housing;

a liquid storage assembly, comprising a water storage part and a liquid storage part, wherein the water storage part is configured to contain clean water, the liquid storage part configured to contain a cleaning liquid;

a liquid pumping assembly, comprising a first pump assembly and a second pump assembly, wherein the first pump assembly is fluidly connected to the water storage part for drawing the clean water, and the second pump assembly is fluidly connected to the liquid storage part for drawing the cleaning liquid;

an execution unit, comprising a heating assembly and a nozzle, wherein the heating assembly is fluidly connected to the first pump assembly for heating the clean water received from the first pump assembly to generate steam, the nozzle is installed on the housing, and the nozzle is configured to be internally hollow to form a channel; and a control assembly configured to be electrically connected to the first pump assembly and the heating assembly to control on/off of the two;

wherein the nozzle is fluidly connected to the heating assembly and the second pump assembly respectively, the channel is configured to allow steam generated by the heating assembly to enter the channel to be sprayed out from a spray orifice, or to enable the steam generated through the heating assembly and the cleaning liquid drawn through the second pump assembly to mix within the channel, forming a mixed fluid to be sprayed out from the spray orifice; and the second pump assembly comprises a pressing handle and a piston pump, the pressing handle is manually operated by a user and abuts against the piston pump to drive the piston pump to quantitatively draw the cleaning liquid from the liquid storage part and deliver the cleaning liquid to the nozzle.

12. The steam cleaner according to claim 11, wherein the nozzle comprises a nozzle steam inlet, a nozzle liquid inlet and the spray orifice, the nozzle steam inlet is fluidly connected to the heating assembly to receive the steam, and the nozzle liquid inlet is fluidly connected to the second pump assembly to receive the cleaning liquid.

13. The steam cleaner according to claim 12, wherein the pressing handle is provided with a hinge shaft and is hinged to the housing through the hinge shaft; and the housing comprises a grip part for the user to stably hold and operate the steam cleaner, and the pressing handle extends into the grip part of the housing.

14. The steam cleaner according to claim 13, wherein the piston pump comprises a contact end that abuts against an inner side wall of the pressing handle; and the piston pump further comprises a piston pump liquid inlet and a piston pump liquid outlet, and the liquid storage part comprises a liquid storage part liquid outlet; and the piston pump liquid inlet is sealingly connected to the liquid storage part liquid outlet through a silicone tube, and the piston pump liquid outlet is sealingly connected to the nozzle liquid inlet through a second silicone tube.

15. The steam cleaner according to claim 12, wherein the liquid pumping assembly further comprises a first pump assembly mounting bracket that is integrally formed with the housing for fixing the first pump assembly.

16. The steam cleaner according to claim 15, wherein the water storage part comprises a water storage part water outlet, and the first pump assembly comprises a first pump assembly water inlet and a first pump assembly water outlet; and the first pump assembly water inlet is sealingly connected to the water storage part water outlet through a silicone tube.

17. The steam cleaner according to claim 16, wherein, the heating assembly comprises a heating assembly water inlet and a heating assembly steam outlet, the heating assembly water inlet is sealingly connected to the first pump assembly water outlet through a silicone tube, and the heating assembly steam outlet is sealingly connected to the nozzle steam inlet through a high-temperature resistant silicone braided tube.

18. The steam cleaner according to claim 11, wherein the heating assembly has a sealed heating chamber inside, and a PTC ceramic heating element is fixedly installed within the heating chamber.

19. The steam cleaner according to claim 11, wherein the control assembly comprises a control screen, a control button and a circuit board;

the control screen is configured to display at least one type of status information among equipment operating gear, steam temperature, and water/liquid remaining amount, and to receive a touch input from the user to select a cleaning mode; and the control button is a press-slide type latch structure configured to continuously activate steam ejection after the user performs a slide-down locking operation and to stop ejection upon release of latching; and the circuit board is electrically connected to the control screen, the control button, the first pump assembly and the heating assembly through wires.

20. The steam cleaner according to claim 11, further comprising a power interface for installing a power cord and connecting to an external power supply to supply power to the control assembly, the first pump assembly and the heating assembly.

* * * * *